US007834602B2

(12) United States Patent
Sun et al.

(10) Patent No.: US 7,834,602 B2
(45) Date of Patent: Nov. 16, 2010

(54) FEEDBACK POWER CONTROL SYSTEM FOR AN ELECTRICAL COMPONENT

(75) Inventors: Tai-Ping Sun, Taoyuan County (TW); Chia-Hung Wang, Taichung (TW); Wei-Shun Cheng, Taichung (TW)

(73) Assignee: National Chi Nan University (TW)

( * ) Notice: Subject to any disclaimer, the term of this patent is extended or adjusted under 35 U.S.C. 154(b) by 399 days.

(21) Appl. No.: 12/151,778

(22) Filed: May 9, 2008

(65) Prior Publication Data

US 2009/0278514 A1 Nov. 12, 2009

(51) Int. Cl.
*G05F 1/565* (2006.01)

(52) U.S. Cl. ..... 323/275; 323/280; 315/308

(58) Field of Classification Search ..... 323/273, 323/275, 277, 280; 315/308, 311
See application file for complete search history.

(56) References Cited

U.S. PATENT DOCUMENTS 5,191,278 A * 3/1993 Carpenter ..... 323/275
6,161,910 A * 12/2000 Reisenauer et al. ..... 315/309
6,917,187 B2 * 7/2005 Okubo et al. ..... 323/275
7,719,207 B2 * 5/2010 Huang et al. ..... 315/294
2007/0080670 A1 * 4/2007 Galinski, III ..... 323/273

* cited by examiner

*Primary Examiner*—Jeffrey L Sterrett
*Assistant Examiner*—Fred E Finch, III
(74) *Attorney, Agent, or Firm*—Schwegman, Lundberg & Woessner, P.A.

(57) ABSTRACT

A feedback power control system includes: a multiplying unit receiving a work voltage corresponding to a voltage drop of an electrical component, and a feedback voltage corresponding to a work current flowing through the electrical component, and outputting a measuring voltage corresponding to a consumed power of the electrical component and having a value equal to a product of a value of the work voltage and a value of the feedback voltage; a control unit receiving the measuring voltage from the multiplying unit, and a reference voltage, and outputting a control voltage corresponding to a voltage difference between the measuring voltage and the reference voltage; and a regulating unit providing the feedback voltage to the multiplying unit, and including an amplifier that receives the feedback voltage from a series connection of transistor and a resistor coupled to the electrical component, and the control voltage from the control unit and that controls operation of the transistor.

7 Claims, 6 Drawing Sheets

FEEDBACK POWER CONTROL SYSTEM FOR AN ELECTRICAL COMPONENT

BACKGROUND OF THE INVENTION

1. Field of the Invention

The invention relates to a power control system, more particularly to a feedback power control system for an electrical component.

2. Description of the Related Art

FIG. 1 illustrates the relationship between an emitted power and a work current of a light emitting diode at different temperatures. In FIG. 1, the emitted power of the light emitting diode decreases with an increase in the temperature of the light emitting diode. Thus, it is required to stabilize the unstable consumed power of the light emitting diode.

In order to stabilize an emitted power of a light emitting diode, a conventional power control circuit 10 has been proposed as shown in FIG. 2. The conventional power control circuit 10 for a light emitting diode 15 includes a photodetector 14 for detecting an emitted power of the light emitting diode 15, and a driving unit 16 for providing a voltage signal or a current signal to the light emitting diode 15 based on the detecting result from the photodetector 14.

However, due to the poor directionality of light emitted by the light emitting diode 15, the detection result is affected by a distance between the photodetector 14 and the light emitting diode 15, the ambient brightness, and sensitivity of the photodetector 14. Furthermore, the photodetector 14 is used to detect the light emitting diode 15 emitting light having a specific wavelength. As a result, the conventional power control circuit 10 cannot ensure stable power control for different light emitting diodes 15.

SUMMARY OF THE INVENTION

Therefore, an object of the present invention is to provide a feedback power control system for an electrical component that can ensure stable power control for the electrical component.

According to the present invention, there is provided a feedback power control system for an electrical component that has first and second electrodes, and a work current flowing therethrough. The feedback power control system comprises:

a multiplying unit having a first input terminal adapted for receiving a work voltage corresponding to a voltage drop between the first and second electrodes of the electrical component, a second input terminal adapted for receiving a feedback voltage corresponding to the work current flowing through the electrical component, and an output terminal for outputting a measuring voltage corresponding to a consumed power of the electrical component, a value of the measuring voltage being equal to a product of a value of the work voltage and a value of the feedback voltage;

a control unit having a first input end coupled to the output terminal of the multiplying unit for receiving the measuring voltage therefrom, a second input end adapted for receiving a reference voltage, and an output end for outputting a control voltage corresponding to a voltage difference between the measuring voltage and the reference voltage; and a regulating unit providing the feedback voltage to the second input terminal of the multiplying unit, and including a series connection of a transistor and a resistor adapted to be coupled to the electrical component and providing the feedback voltage, and an amplifier having a first input end for receiving the feedback voltage form the series connection of the transistor and the resistor, a second input end coupled to the output end of the control unit for receiving the control voltage therefrom, and an output end coupled to the transistor for controlling operation of the transistor.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
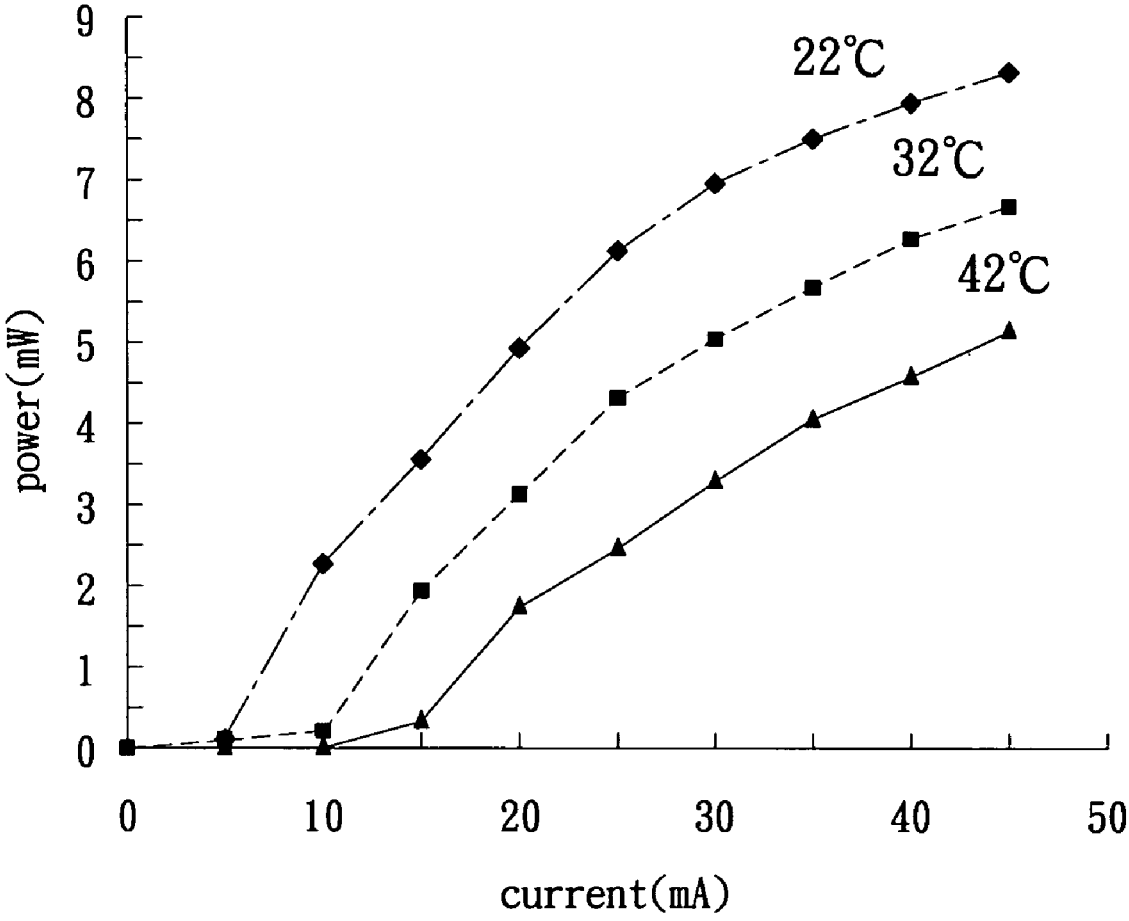
FIG. 1 PRIOR ART
FIG. 1 is a plot illustrating the relationship between an emitted power and a work current of a light emitting diode at different temperatures.
Figure 2:
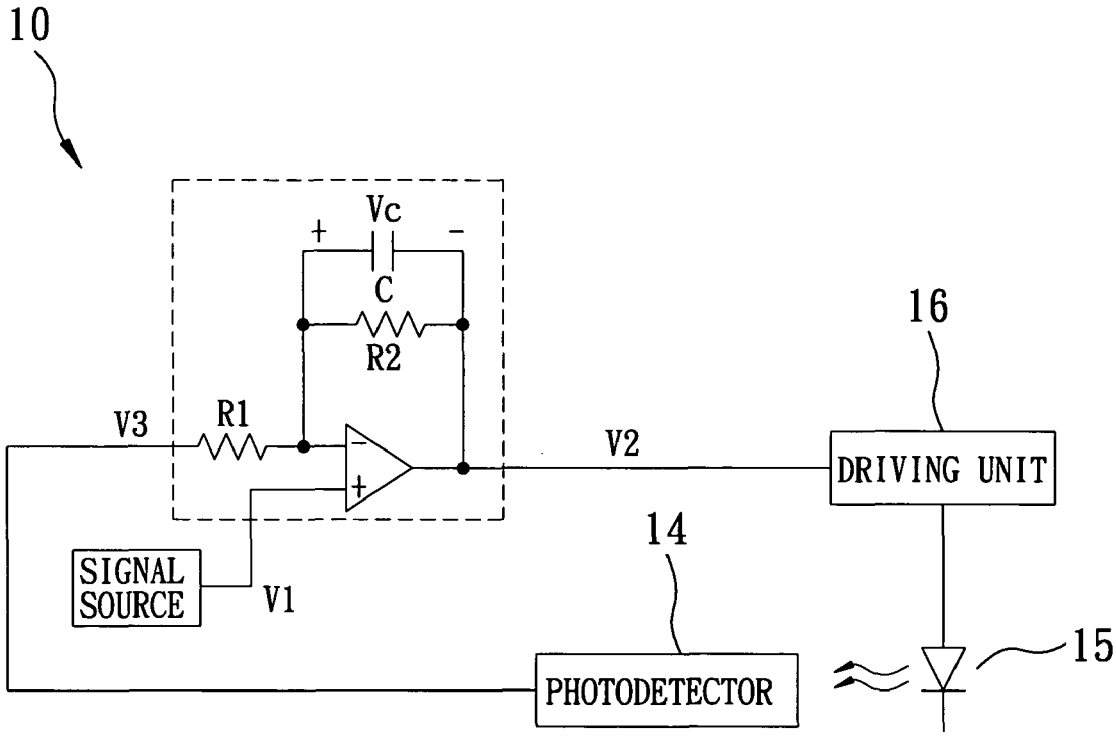
FIG. 2 PRIOR ART
FIG. 2 is a schematic electrical circuit block diagram of a conventional power control circuit for a light emitting diode.
Figure 3:
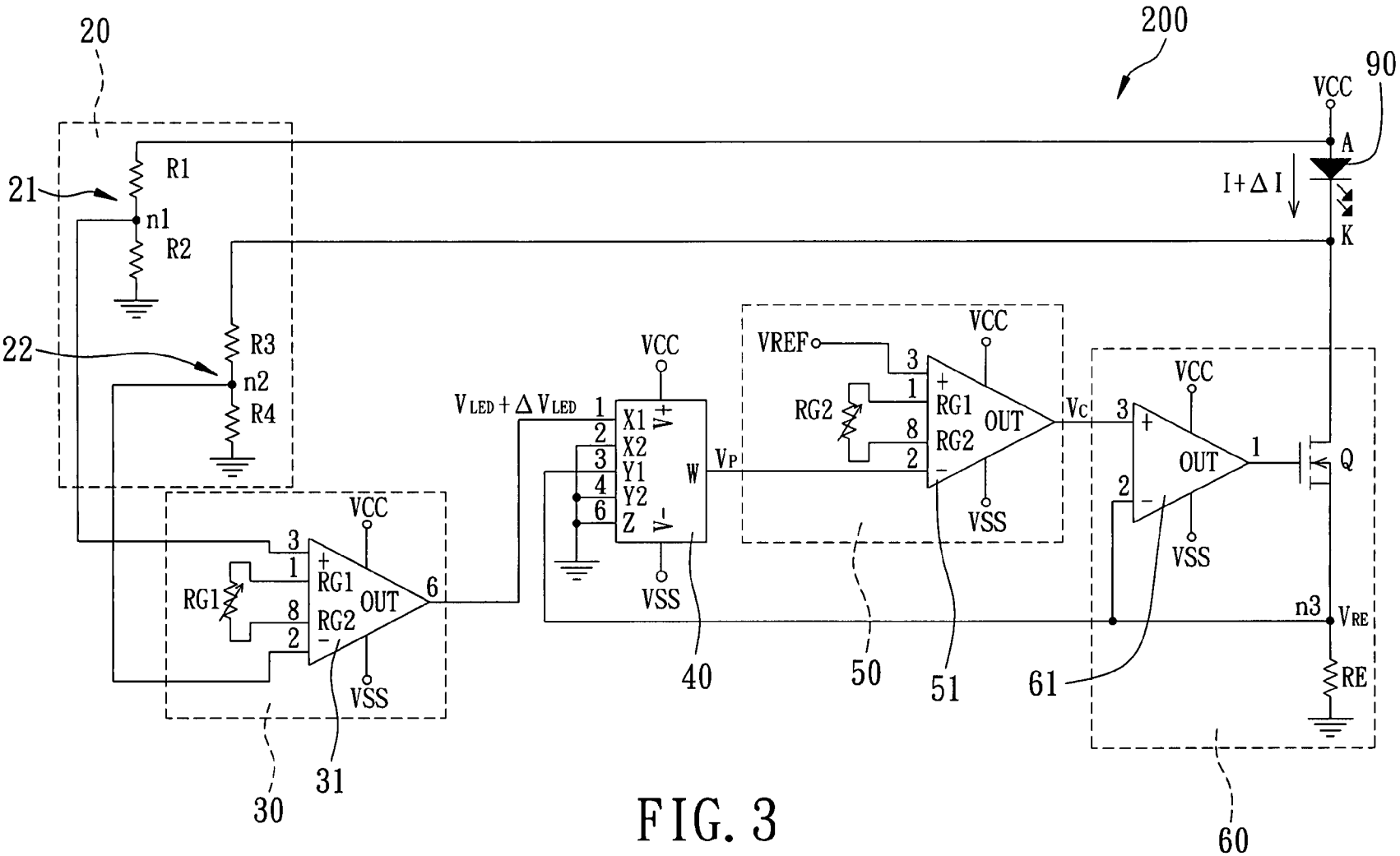
FIG. 3 is a schematic electrical circuit diagram illustrating the preferred embodiment of a feedback power control system for an electrical component according to the present invention.

Referring to FIG. 3, the preferred embodiment of a feedback power control system 200 for an electrical component 90 according to the present invention is shown to include a voltage dividing unit 20, an amplifying unit 30, a multiplying unit 40, a control unit 50, and a regulating unit 60. In this embodiment, the electrical component 90 is a light emitting diode, and has first and second electrodes (A, K), and a work current ($I_{LED}$) flowing therethrough. In other embodiments, the electrical component 90 can be a laser diode.

The voltage dividing unit 20 includes a series connection 21 of first and second resistors (R1, R2) adapted to be coupled between the first electrode (A) of the electrical component 90 and ground, and a series connection 22 of third and fourth resistors (R3, R4) adapted to be coupled between the second electrode (K) of the electrical component 90 and ground.

The amplifying unit 30 includes an amplifier 31 and a variable resistor ($R_{G1}$). The amplifier 31 has an input unit that includes four inputs, one of which is a non-inverting input end and is coupled to a node (n1) between the first and second resistors (R1, R2) of the voltage dividing unit 20, and another one of which is an inverting input end and is coupled to a node (n2) between the third and fourth resistors (R3, R4) of the voltage dividing unit 20, and an output end for outputting a work voltage corresponding to a voltage drop between the first and second electrodes (A, K) of the electrical component 90. The variable resistor ($R_{G1}$) is coupled between the other ones of the inputs of the input unit of the amplifier 31, and is operable so as to adjust an output gain of the amplifier 31. A value of the work voltage can be expressed as $V_{LED}+\Delta V_{LED}$, where $\Delta V_{LED}$ indicates a voltage variation in response to temperature variation.

The multiplying unit 40 has a first input terminal (X1) coupled to the output end of the amplifier 31 of the amplifying unit 30, a second input terminal (Y1) adapted for receiving a feedback voltage ($V_{RE}$) corresponding to the work current flowing through the electrical component 90, and an output terminal (W) for outputting a measuring voltage ($V_P$) corresponding to a consumed power of the electrical component 90. A value of the measuring voltage ($V_P$) is equal to a product of the value ($V_{LED}+\Delta V_{LED}$) of the work voltage and a value ($V_{RE}$) of the feedback voltage. In other words, the measuring voltage ($V_P$) can be expressed as follows:

$$V_P=(V_{LED}+\Delta V_{LED})\times V_{RE}$$

Where $\Delta V_{LED}$ is a voltage variance of the work voltage of the electrical component 90 corresponding to a temperature variance of the electrical component 90.

In this embodiment, the control unit 50 includes an amplifier 51, such as an operational amplifier, and a variable resistor ($R_{G2}$). The amplifier 51 has an input unit that has a first input end, such as an inverting input end, coupled to the output terminal (W) of the multiplying unit 40 for receiving the measuring voltage ($V_P$) therefrom, a second input end, such as a non-inverting input end, adapted for receiving a reference voltage ($V_{REF}$) that can be adjusted by the user depending on requirements, and third and fourth input ends, and an output end for outputting a control voltage ($V_C$) corresponding to a voltage difference between the measuring voltage ($V_P$) and the reference voltage ($V_{REF}$). The variable resistor ($R_{G2}$) is coupled between the third and fourth input ends of the input unit of the amplifier 51. A gain (G) of the amplifier 51 can be adjusted by adjusting resistance of the variable resistor ($R_{G2}$) to suit different types of the electrical component 90. Thus, the control voltage ($V_C$) can be expressed as follows:

$$V_C=G\times(V_{REF}-V_P)$$

In this embodiment, the regulating unit 60 includes a series connection of a transistor (Q) and a resistor ($R_E$), and an amplifier 61. The transistor (Q), such as a field effect transistor or a bipolar junction transistor, is adapted to be coupled between the second electrode (K) of the electrical component 90 and the resistor ($R_E$). The resistor ($R_E$) is coupled between the transistor (Q) and ground. A node (n3) between the transistor (Q) and the resistor ($R_E$) is coupled to the second input terminal (Y1) of the multiplying unit 40. In this embodiment, a potential at the node (n3) serves as the feedback voltage ($V_{RE}$). The amplifier 61 has a first input end, such as an inverting input end, coupled to the node (n3) for receiving the feedback voltage ($V_{RE}$) from the node (n3), a second input end, such as a non-inverting input end, coupled to the output end of the amplifier 51 of the control unit 50 for receiving the control voltage ($V_C$), and an output end coupled to a gate of the transistor (Q) for controlling operation of the transistor (Q).

Further, the open-loop gain (GM(0)) of the feedback power control system 200 can be expressed as follows:

$$GM(0)=A_{V0}\times g_m$$

where $A_{V0}$ is the open-loop gain of the amplifier 61 of the regulating unit 60, and $g_m$ is the admittance of the transistor (Q).

Upon considering the resistance of the resistor ($R_E$), the closed-loop gain (GMf) of the feedback power control system 200 can be expressed as follows:

$$GMf=\frac{GM(0)}{1+GM(0)R_E}=\frac{A_{V0}\times g_m}{1+(A_{V0}\times g_m)R_E}\cong\frac{1}{R_E}$$

As a result, the work current ($I_{LED}$) of the electrical component 90 is closely related to the resistor ($R_E$), and has insignificant relation to the transistor (Q). Thus, the work current ($I_{LED}$) can be expressed as follows:

$$\begin{aligned}I_{LED}&=\frac{G\{V_{REF}-[V_{RE}\times(V_{LED}+\Delta V_{LED})]\}}{R_E}\\&=\frac{G(V_{REF}-V_{RE}\times V_{LED})}{R_E}+\frac{G\times V_{RE}\times V_{LED}}{R_E}\\&=I+\Delta I\end{aligned}$$

where $\Delta I$ is a current variance of the work current ($I_{LED}$) corresponding to the temperature variance of the electrical component 90.

Therefore, stabilization of the consumed power of the electrical component 90 can be attained by selecting appropriately the reference voltage ($V_{REF}$) and the resistance of the resistor ($R_E$). In actual use, if the work voltage of the electrical component 90 is reduced as a result of an increase in the temperature of the electrical component 90, the measuring voltage ($V_P$) outputted by the multiplying unit 40 is reduced, and the control voltage ($V_C$) outputted by the control unit 50 is increased, thereby resulting in a corresponding increase in the work current ($I_{LED}$). Therefore, the increased work current ($I_{LED}$) and the decreased work voltage can stabilize the consumed power of the electrical component 90.

Figure 4:
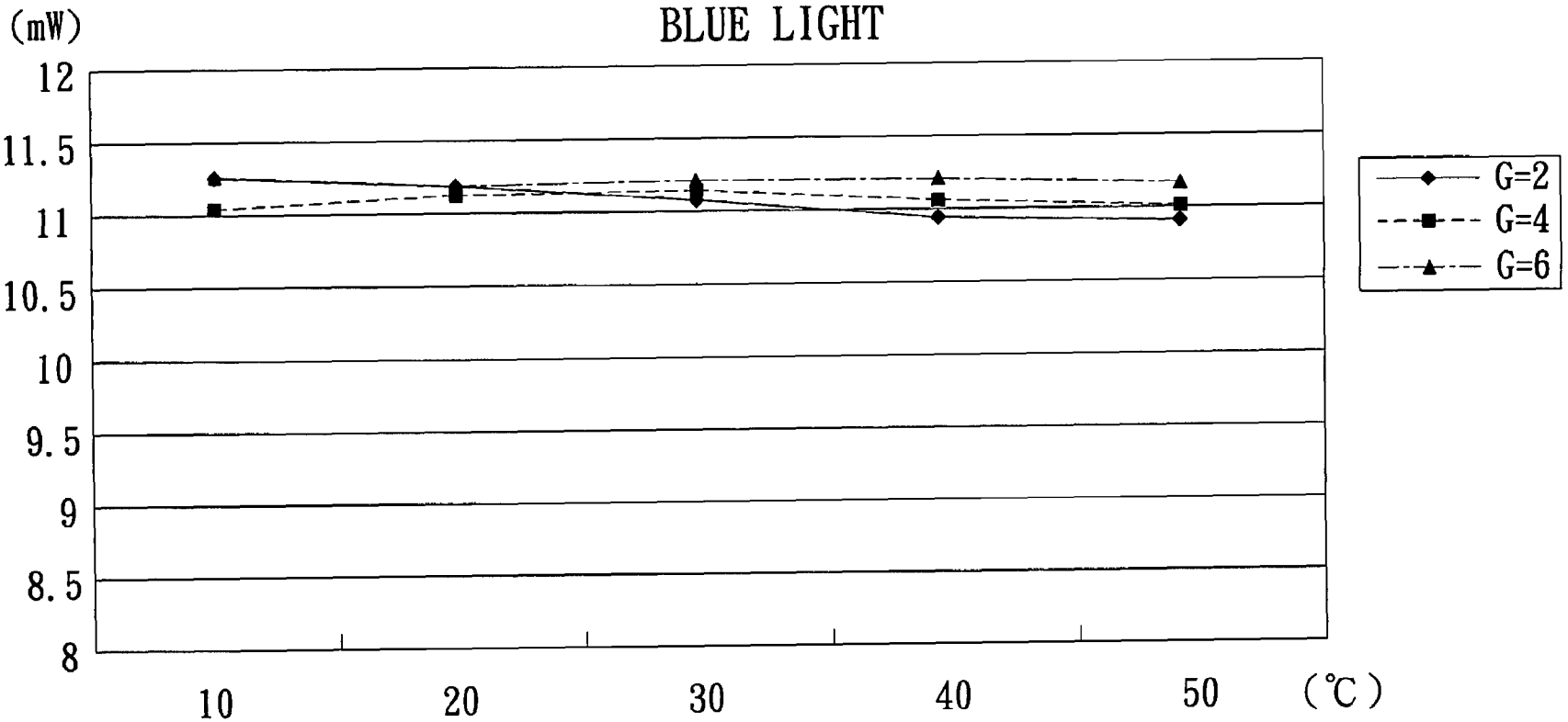
FIG. 4 is a graph illustrating the relationship between an emitted power and temperature of the electrical component radiating blue under different gains of an amplifier of a control unit.
Figure 5:
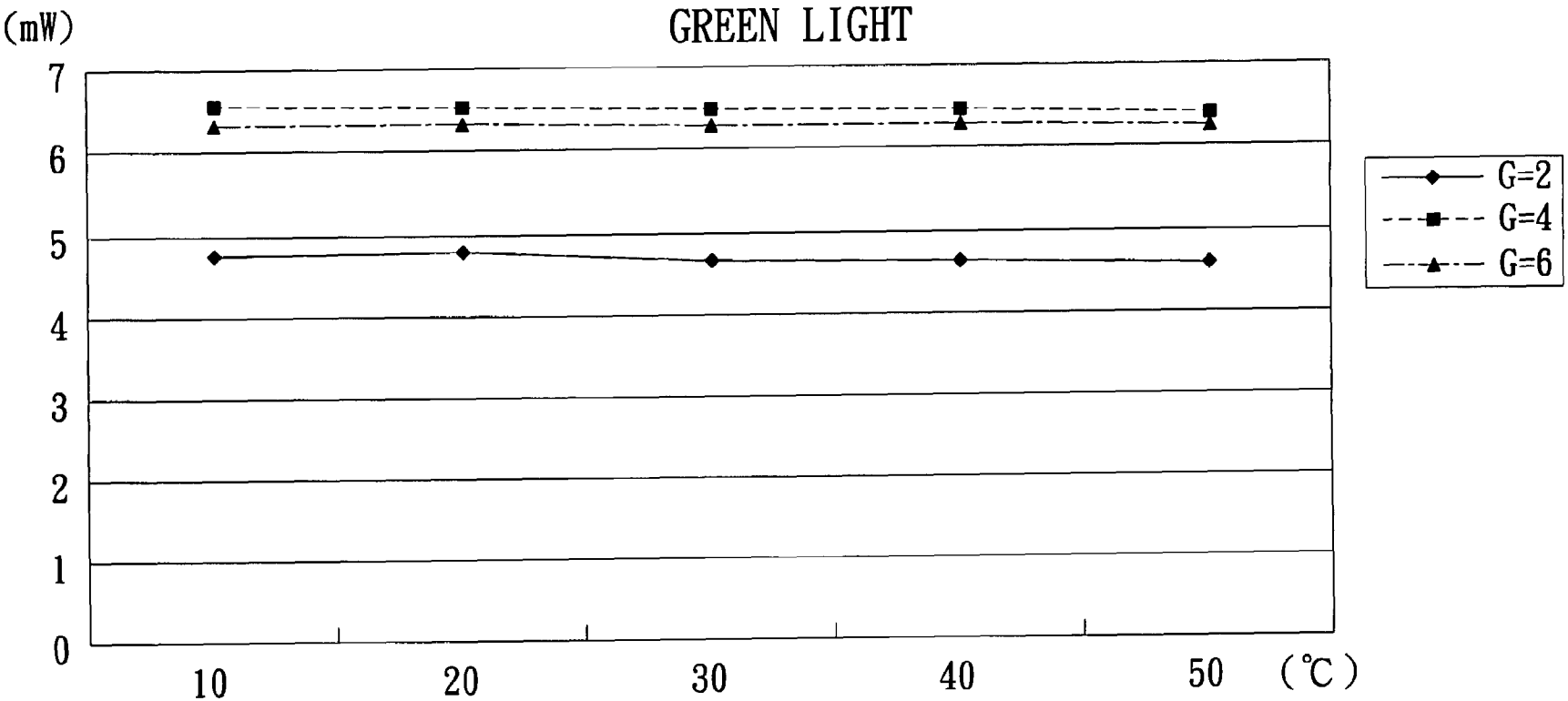
FIG. 5 is a graph illustrating the relationship between the emitted power and temperature of the electrical component radiating green light and controlled by the preferred embodiment under the different gains of the amplifier of the control unit.
Figure 6:
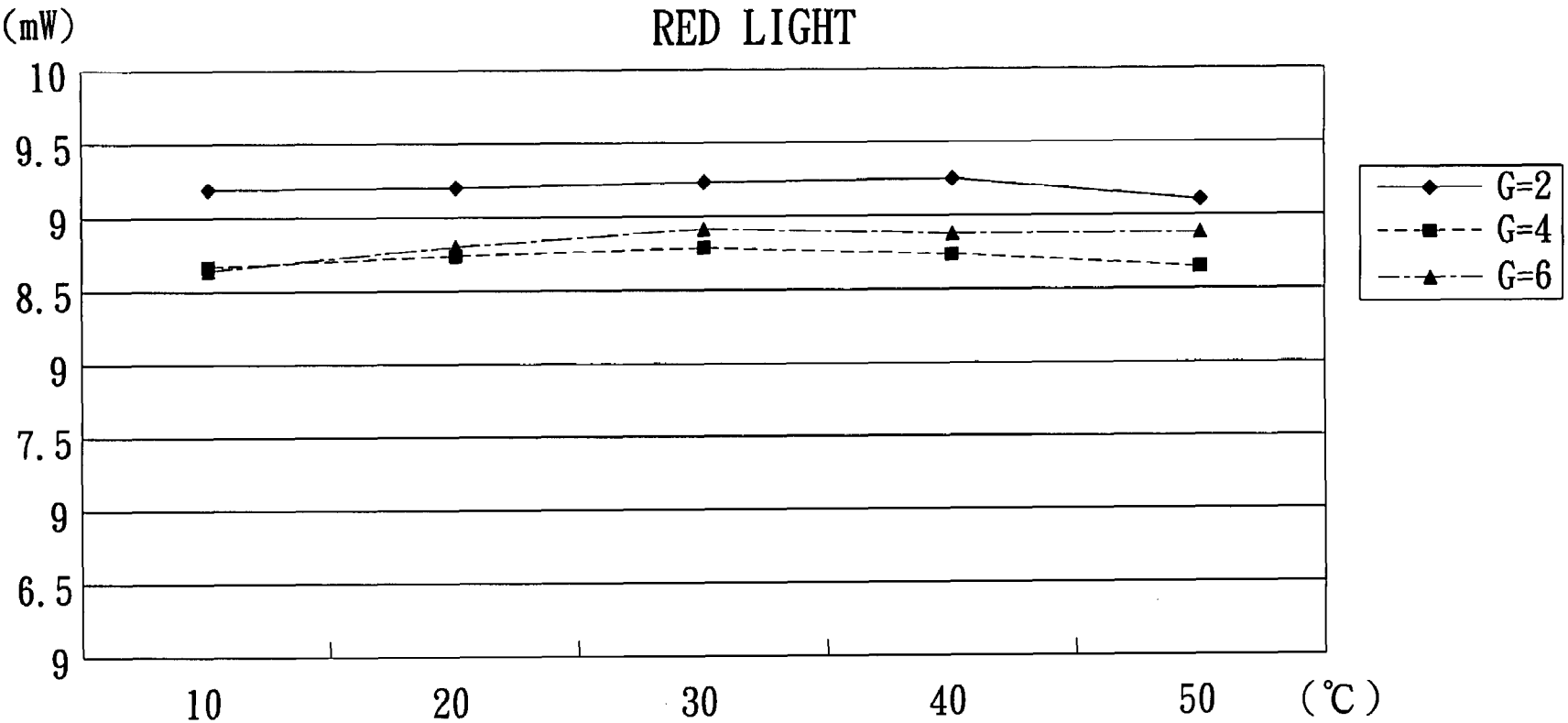
FIG. 6 is a graph illustrating the relationship between the emitted power and temperature of the electrical component radiating red light and controlled by the preferred embodiment under the different gains of the amplifier of the control unit.

FIGS. 4, 5 and 6 illustrate experimental results of power control for light emitting diodes emitting respectively blue light, green light and red light by the feedback power control system 200 of this invention at different gains, such as 2, 4 and 6, of the amplifier 51 of the control unit 50. From the experimental results, stabilization of the consumed powers of the light emitting diodes can be achieved without the need for a photodetector.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

We claim:

1. A feedback power control system for an electrical component that has first and second electrodes, and a work current flowing therethrough, said feedback power control system comprising:

a multiplying unit having a first input terminal adapted for receiving a work voltage corresponding to a voltage drop between the first and second electrodes of the electrical component, a second input terminal adapted for receiving a feedback voltage corresponding to the work current flowing through the electrical component, and an output terminal for outputting a measuring voltage corresponding to a consumed power of the electrical component, a value of the measuring voltage being equal to a product of a value of the work voltage and a value of the feedback voltage;

a control unit having a first input end coupled to said output terminal of said multiplying unit for receiving the measuring voltage therefrom, a second input end adapted for receiving a reference voltage, and an output end for outputting a control voltage corresponding to a voltage difference between the measuring voltage and the reference voltage; and a regulating unit providing the feedback voltage to said second input terminal of said multiplying unit, and including a series connection of a transistor and a resistor adapted to be coupled to the electrical component and providing the feedback voltage, and an amplifier having a first input end for receiving the feedback voltage from the series connection of said transistor and said resistor, a second input end coupled to said output end of said control unit for receiving the control voltage therefrom, and an output end coupled to said transistor for controlling operation of said transistor.

2. The feedback power control system as claimed in claim 1, wherein said transistor of said regulating unit is adapted to be coupled between the second electrode of the electrical component and said resistor, said resistor being coupled between said transistor and ground, a node between said transistor and said resistor being coupled to said second input terminal of said multiplying unit and said first input end of said amplifier, a potential at said node serving as the feedback voltage.

3. The feedback power control system as claimed in claim 1, wherein said first and second input ends of said amplifier of said regulating unit are inverting and non-inverting input ends, respectively.

4. The feedback power control system as claimed in claim 1, further comprising an amplifying unit that includes:

an amplifier having an input unit adapted to be coupled to the first and second electrodes of the electrical component, and an output end coupled to said first input terminal of said multiplying unit for outputting the work voltage to said multiplying unit;

a variable resistor coupled to said input unit of said amplifier of said amplifying unit.

5. The feedback power control system as claimed in claim 4, further comprising a voltage dividing unit that includes:

a series connection of first and second resistors adapted to be coupled to the first electrode of the electrical component, a node between said first and second resistors being coupled to said input unit of said amplifying unit; and a series connection of third and fourth resistors adapted to be coupled to the second electrode of the electrical component, a node between said third and fourth resistors being coupled to said input unit of said amplifier of said amplifying unit.

6. The feedback power control system as claimed in claim 1, wherein said control unit includes:

an amplifier having an input unit that includes said first and second input ends, and said output end of said control unit; and a variable resistor coupled to said input unit of said amplifier of said control unit.

7. The feedback power control system as claimed in claim 1, wherein said transistor is a field effect transistor having a gate coupled to said output end of said amplifier of said regulating unit.

* * * * *